US009501040B2

(12) United States Patent
McNulty, Jr.

(10) Patent No.: US 9,501,040 B2
(45) Date of Patent: Nov. 22, 2016

(54) APPLIANCE OR LIGHT TIMER INCLUDING RECHARGEABLE BACK-UP BATTERY AND EXTERNAL CHARGER

(71) Applicant: William J. McNulty, Jr., Provo (TC)

(72) Inventor: William J. McNulty, Jr., Provo (TC)

( * ) Notice: Subject to any disclaimer, the term of this patent is extended or adjusted under 35 U.S.C. 154(b) by 127 days.

(21) Appl. No.: 14/504,271

(22) Filed: Oct. 1, 2014

(65) Prior Publication Data

US 2016/0098015 A1 Apr. 7, 2016

(51) Int. Cl.

| | |
|---|---|
| ***G04C 23/00*** | (2006.01) |
| ***G04C 23/18*** | (2006.01) |
| ***H01H 43/10*** | (2006.01) |
| ***G04C 23/06*** | (2006.01) |

(52) U.S. Cl.

CPC ..... *G04C 23/18* (2013.01); *G04C 23/00* (2013.01); *G04C 23/06* (2013.01); *H01H 43/10* (2013.01)

(58) Field of Classification Search

CPC ..... G04B 23/00; G04B 23/06; G04B 23/08; G04B 23/12; G04B 23/14; G04B 23/18; H01H 43/00; H01H 43/10

USPC ..... 368/10; 307/141, 141.4

See application file for complete search history.

(56) References Cited

U.S. PATENT DOCUMENTS 3,997,742 A * 12/1976 Marquis ..... H01H 43/028 200/38 D
4,015,420 A * 4/1977 Walker ..... G04G 9/00 368/64
4,123,628 A * 10/1978 Kern ..... H01H 43/10 200/38 D
4,297,546 A * 10/1981 Koch ..... H01H 43/028 200/38 D
4,668,878 A * 5/1987 Wyss ..... G04G 15/006 307/139
4,763,310 A * 8/1988 Goetzberger ..... G04C 10/02 368/205
4,775,801 A * 10/1988 Baum ..... G04F 10/10 307/109
5,191,231 A * 3/1993 Berry ..... H01H 43/00 307/141.4
5,258,656 A * 11/1993 Pawlick ..... G04G 15/006 307/141
5,602,456 A * 2/1997 Cargin, Jr. ..... B60R 11/02 320/112
5,715,214 A * 2/1998 Svarnias ..... H01H 43/065 200/35 R
5,754,029 A * 5/1998 Mann ..... G11B 31/006 320/106
5,844,328 A * 12/1998 Furst ..... H02J 9/062 307/64
5,955,796 A * 9/1999 Nilssen ..... G04F 1/005 200/38 B
6,027,828 A * 2/2000 Hahn ..... H01M 2/1022 429/100
7,154,380 B1 * 12/2006 Tarrab, Jr. ..... G04G 15/006 273/148 B
7,978,465 B2 * 7/2011 Osaka ..... G05B 19/05 248/917
8,925,841 B2 * 1/2015 Jensen ..... B02C 25/00 241/100
2009/0261661 A1 * 10/2009 Finneran ..... H02J 9/005 307/141.8
2012/0112666 A1 * 5/2012 Bennette ..... H05B 37/0218 315/307
2015/0061546 A1 * 3/2015 Stack ..... G04G 15/006 315/360

* cited by examiner

*Primary Examiner* — Vit W Miska
(74) *Attorney, Agent, or Firm* — Polsinelli PC

(57) ABSTRACT

A timer in which primary (household or solar or wind) electrical power is used as a source to direct the primary power to an electrically powered device, such as an appliance or light. Electrical energy for the timer can be provided by the household current (or solar/wind power), optionally suitably transformed or inverted to provide acceptable voltage of either AC or DC to operate a motor or CPU. In case of interruption of the source of the primary electrical power, rechargeable battery(s) housed within the case of the timer will operate the timer until the primary source of electrical power is restored. The case can also accommodate additional rechargeable battery(s) in a charging station, which additional rechargeable battery(s) are not required to power the tinier in the event of loss of primary power.

13 Claims, 7 Drawing Sheets

APPLIANCE OR LIGHT TIMER INCLUDING RECHARGEABLE BACK-UP BATTERY AND EXTERNAL CHARGER

BACKGROUND OF THE INVENTION

1. Field of the Invention

In one embodiment, the invention pertains to a timer in which household electrical power (in the United States-115 Volts AC; in some other countries 230 Volts AC or DC) is used as a switch to direct the household current to the appliance or light source. The switch can be regulated mechanically by a motor turning a gear train to rotate a dial. The dial may be provided with at least one On-Off cycle every twenty four hours. Multiple On-Off cycles ma also be provided to be operated by the single dial. Alternatively, one or more on-off cycles may be operated by digitally programming a central processing unit ("CPU") to operate an electronic, or mechanical switch. Electrical energy for either the motor or digital programming can be provided by the household current, optionally suitably transformed or inverted to provide acceptable voltage of either AC or DC to operate the motor/CPU. In conditions where the household current is interrupted due to storms, accidents or other conditions, the timer of the invention is operated by a self-contained rechargeable battery. This self-contained battery will continue to operate the motor or CPU, as necessary, to keep the timer of the invention synchronous with external time and maintain the preset On-Off cycle(s). Of course, the rechargeable battery of the timer will not have the capacity to supply the household current to the appliance/light, but will turn On, and/or turn Off the output receptacle, even though the household current is not being applied to the timer. In a further embodiment, the timer can also charge external rechargeable battery(s), which external battery(s) may be independent of the tuning circuit and operation of the On-Off switching functions, or alternatively, may also aid in providing energy to the timer itself when the household power is interrupted.

2. Description of the Related Art

In a most simply form, timers are known to transfer household electrical supply from a source of suitable electric current, to an electrically powered device, such as an appliance or light. One such device is shown in U.S. Design Pat. No. D380,396, the entire disclosure of which is hereby incorporated by reference. As shown in FIG. 1 herein (Prior Art) the timer 8 is provided in a case 10, which houses a motor (not shown) to rotate a dial 12. The dial 12 may be provided with suitable indicia 13 representing units of time, such as hours and subdivisions thereof. Mechanically operated actuators 14, 16, 18, 20 may be placed about the periphery of dial 12, in order to mechanically operate a switch 25 to turn the switch 25 either On or turn the switch 25 Off to connect, or alternatively, interrupt the connection of the household power supply to the output receptacle 24. By having a number of such actuators 14, 16, 18 and 20 (or more or less, as desired) multiple On-Off cycles can be regulated by the timer. Alternatively, a digital clock circuit may be used to turn the switch On-Off to connect/interrupt the household electrical supply to the output receptacle in response to an integrated circuit (IC) or a programmable CPU (not shown) that provides even greater flexibility in the number of On-Off cycles that can be provided to the appliance timer.

As shown in FIG. 2 (Prior Art) the household electrical supply may be obtained by inserting prongs (such as prong 22, 23) into a source of household electrical supply, such as a receptacle (not shown) which is the source of the household electrical current. A plug (not shown) of the appliance/light may be inserted into output receptacle 24 in case 10. Although a conventional United States polarized receptacle is illustrated in FIG. 2, it should be understood that in the invention, the receptacle may include a grounding opening; or may be configured for other countries, i.e., any of the conventional 220 Volt AC or DC systems. Upon actuation of a switch 25 by any of the actuators 14, 16, 18 or 20, an electrical connection is made between prongs 22, 23 and output receptacle 24 permitting power to flow to the appliance/light to energize the same. Alternative the switch 25 may open terminating the electrical connection.

A problem with the prior art device illustrated in FIGS. 1-2 is the fact that any interruption of the household current will cause the motor to cease rotation thereby throwing the timer of the prior art out of synchronicity with external time. Upon re-establishment of the household current, the motor will begin to operate as normal, but because of the lack of continuous operation, the timer will now be asynchronous with external time. Thus, the actuators will not operate as desired to actuate the appliance/light at the desired time, but will turn the switch 25 On or Off at inappropriate times.

Heretofore, there has not been an appliance/light timer to overcome this problem.

SUMMARY OF THE INVENTION

In one embodiment of the invention, an independent power source, such as rechargeable battery(s) 205, is included within a case 110 (FIG. 3). The rechargeable battery(s) 205 is of a size sufficient to maintain the energization of the primary motor so as to maintain the rotation of dial 112 (FIG. 4) in synchronicity with external time even though the household current is absent. As with the prior art, dial 112 may have indicia thereon to indicated divisions of time, such as hours or portions thereof. Additionally moveable actuators, such as actuator 114, may be provided to work in concert with dial 112 to perform an action, such as turning power On or Off to the output receptacle 124.

In a farther embodiment, a second motor, rather than the primary motor, is energized by the rechargeable battery. The second motor will maintain the rotation of the dial 112, but will draw power exclusively from the rechargeable battery 205 and will not be operated by the household power supply. Thus, the second motor need not share any power requirements of the primary motor (such as voltage amount or type (AC or DC), or power requirements). A normally closed switch, operated by the household current to be held open, will close upon cessation, or reduction in voltage/amperage of household power supply to enable the rechargeable battery to operate the primary or secondary motor during periods of interruption or degradation (brown-out) of the household power supply.

In a still further embodiment of the invention, the timer of the invention is provided with a charging station 200, which can be used to recharge rechargeable battery(s) for non-timer use, i.e., these rechargeable battery(s) do not have to operate any part of the timer mechanism and can be removed from the charging station 200 of the device 100 and used to supply energy to other battery powered devices.

In a still further embodiment, the charging station 200 can be used as a source of additional battery power as a back-up to, or as a supplement to the internal rechargeable battery(s) enclosed in case 110. Although a single battery 205 is illustrated, the single battery 205 could be replaced by a plurality of battery(s) 205 without departing from the gist of the invention.

DETAILED DESCRIPTION OF THE PREFERRED EMBODIMENTS

Figure 1:
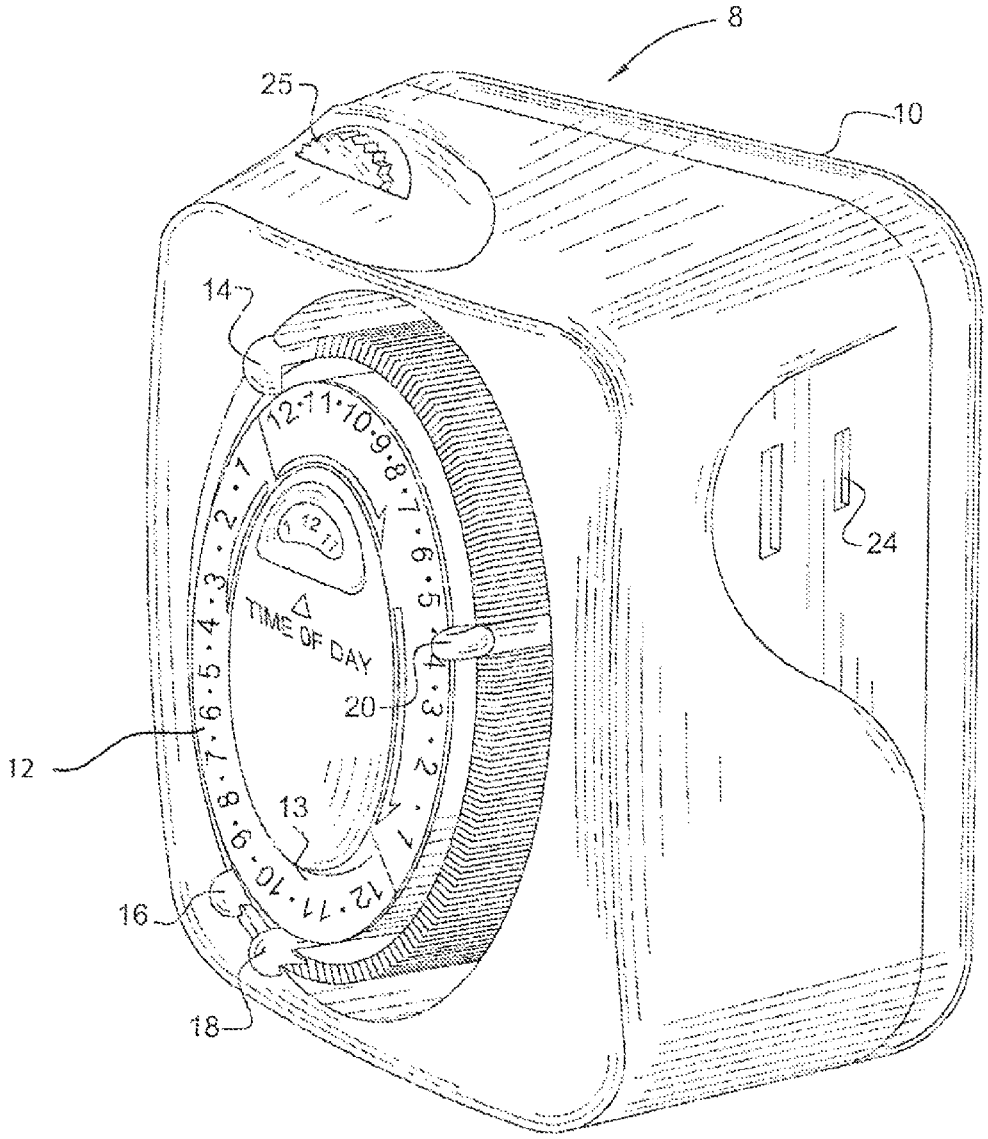
FIG. 1 (PRIOR ART)
FIG. 1 (Prior Art) is a perspective view of a tinier according to the prior art.
Figure 2:
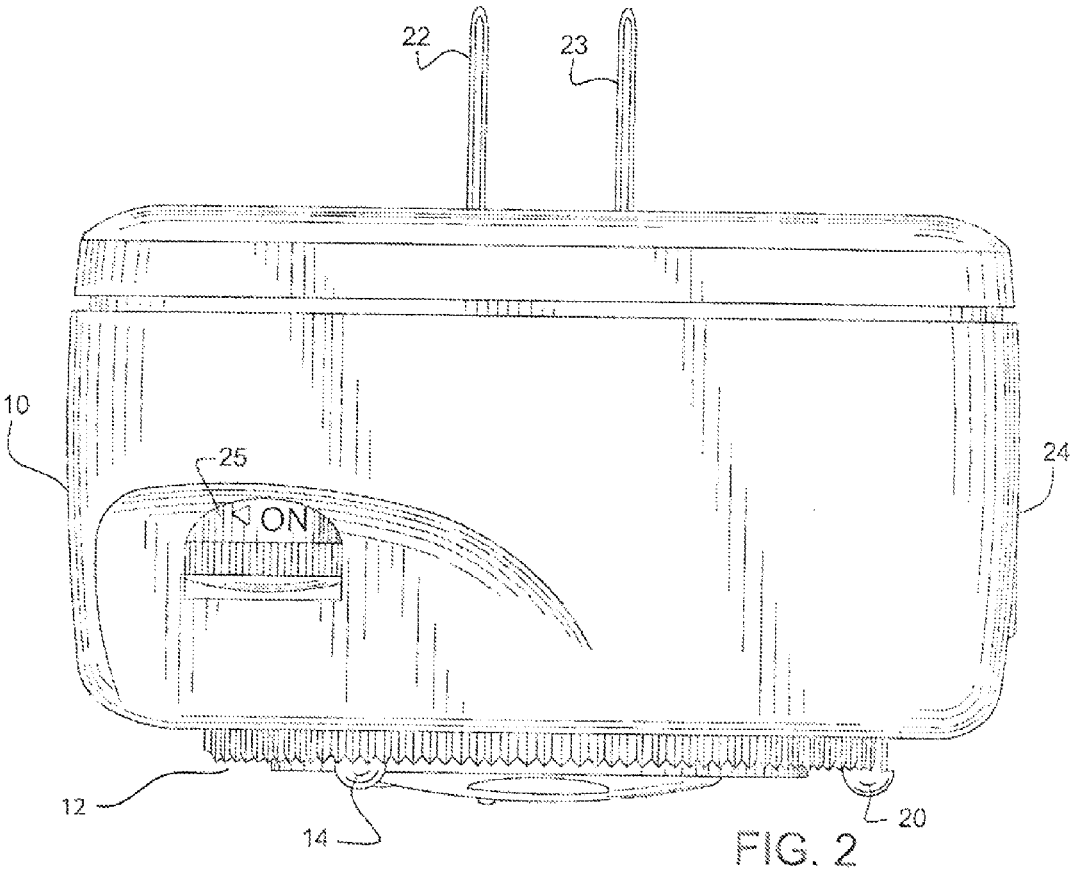
FIG. 2 (PRIOR ART)
FIG. 2 (Prior Art) is a top view of the timer of FIG. 1.

In the following detailed description of the preferred embodiment, not every element of the timer is reproduced in every drawing figure for clarity, but it is to be expressly understood that the various elements disclosed herein can be embodied in each embodiment illustrated in the drawings according to the invention. The rechargeable batteries used in the present invention may be of the sizes conventionally known as "D", "C", "AA", or "AAA", etc. The timer of the invention may also be used to charge a mix of differently sized batteries, such as a "123" battery within the case 110 and "AA" batteries in the charging station 200. All that is necessary is that the rechargeable batteries are appropriately sized for their function.

In one embodiment of the invention, the timer 100 of the invention is provided with a case 110, which case 110 is provided with prongs 122, 123 to be insertable into an appropriate source of household power supply, such as a receptacle (not shown) which is the source of household electrical supply. While I have illustrated a conventional, polarized receptacle as used in the United States, it should be understood that other type/configurations of prongs to match receptacles used in the United States and other parts of the world could be substituted for prongs 122, 123 without the exercise of invention. For example, a grounded prong could be included with prongs 122, 123, without departing from the invention. Prongs configured for 220 Volt receptacles as might be used in various countries throughout the world could be provided as an alternative to those illustrated in the drawings. Typical lights operable by the timer of the invention could be a household lamp or combination of lamps. Alternatively, the timer could operate one or more electrically powered devices, such as electrically powered appliances, such as a fan, a television, a pet food dispenser, and similar electrically powered devices or appliances. Similarly, though not illustrated, the timer 100 could be "hard-wired" to a source of household electrical supply by the connection of household wiring to terminals 125, 128 (FIG. 5) provided within the case 110, thereby eliminating the need for prongs 122, 123 without departing from the invention. However, the timer 100 provided with a case 110, as illustrated in the various views of the drawings, presents the most versatile type of timer, being not only portable and capable of being used throughout various locations within a building, but also requiring no electrical knowledge on the part of the operator except for the operator being capable of inserting the plug of the appliance/light into receptacle 124 and inserting prongs 122, 123 into a receptacle of appropriate household current.

Figure 3:
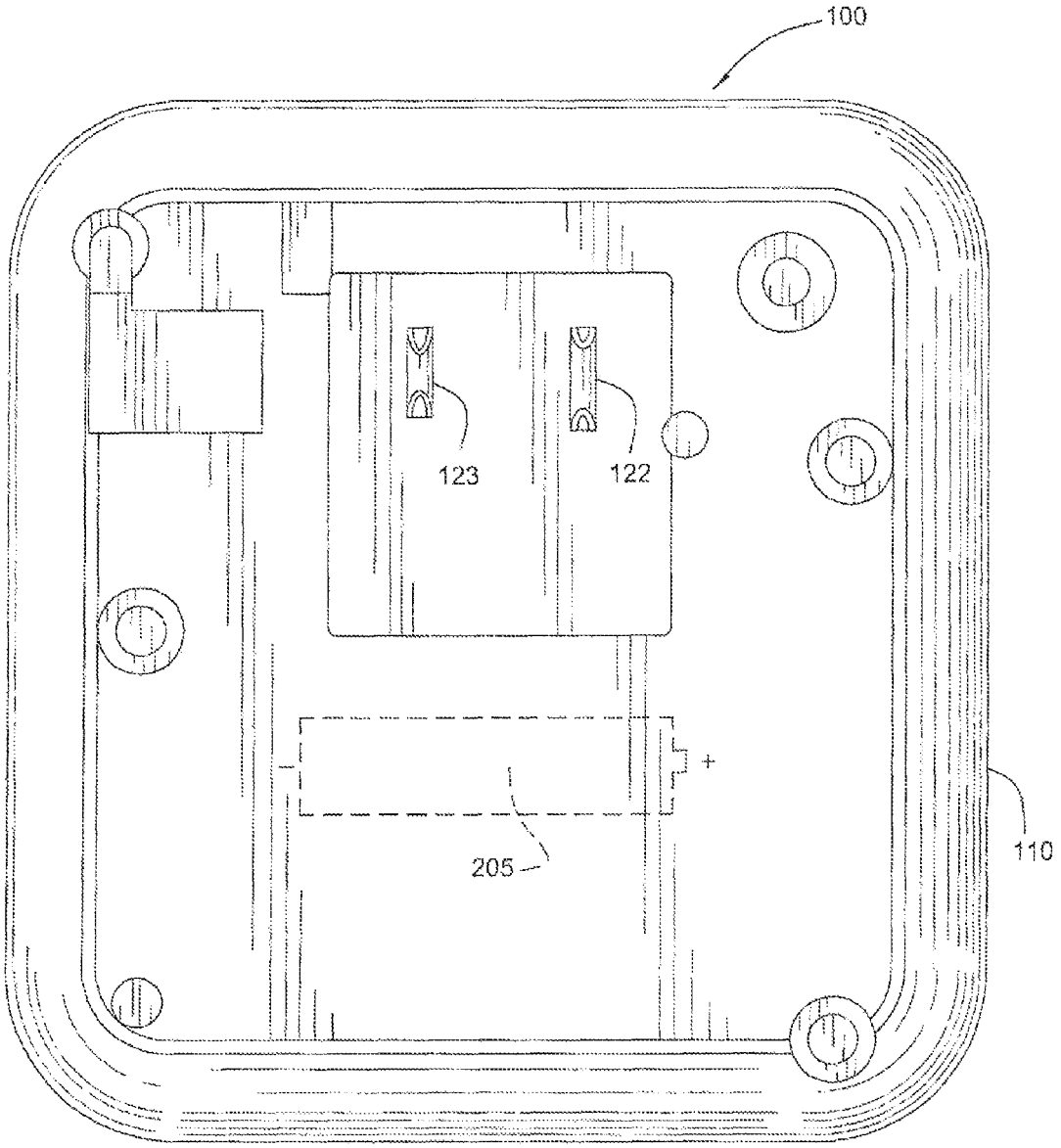
FIG. 3 is a rear view of the timer of the invention.
Figure 4:
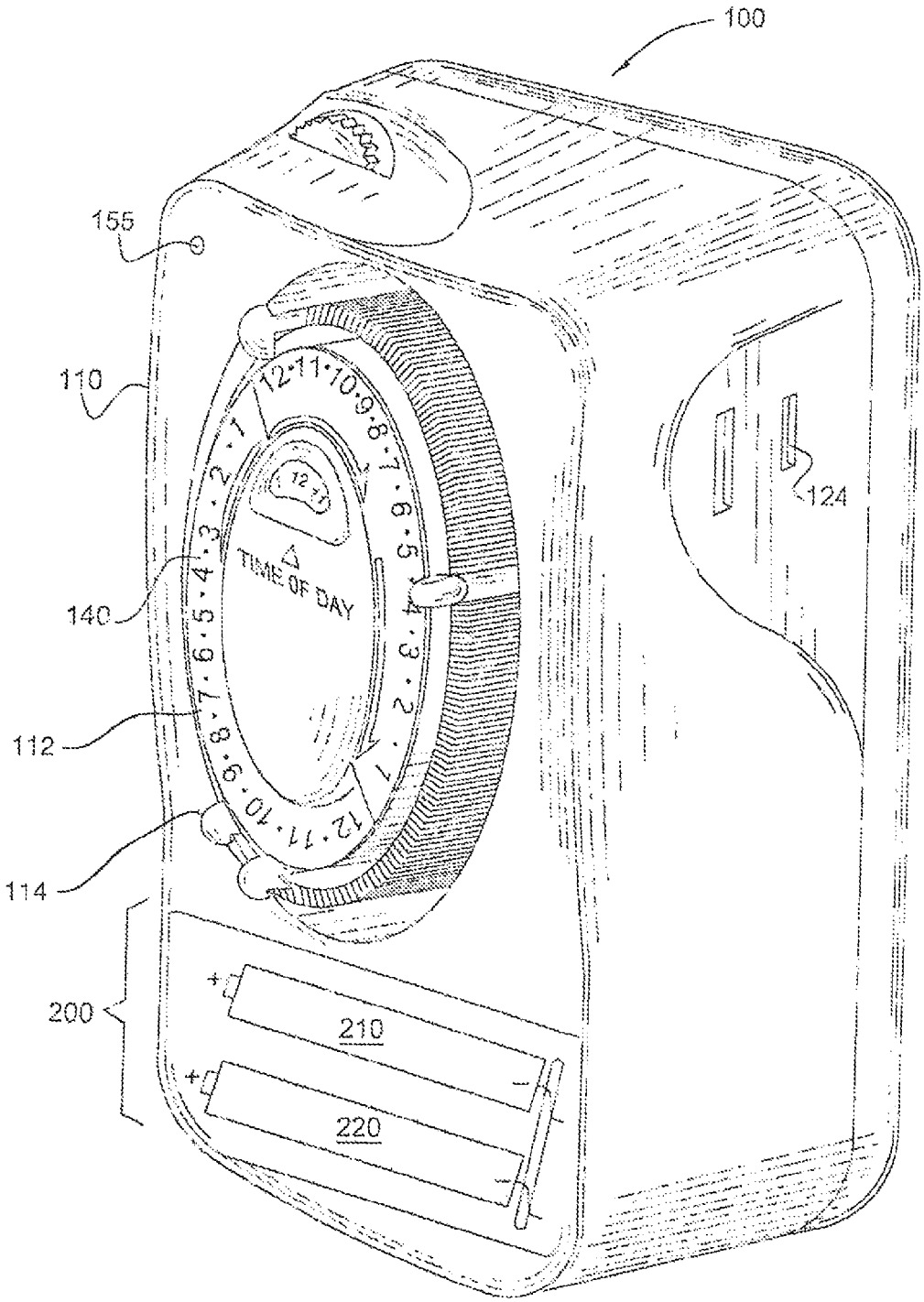
FIG. 4 is a perspective view of another embodiment of the timer of the invention illustrating the auxiliary charging station.

As shown in FIG. 3, a battery 205 is contained within case 110 to supply power to the timer 100 in the event of failure of the external power supply. Although not illustrated, a sliding or removable cover can be provided to access battery 205 for periodic maintenance, such as replacement thereof. An indicator light 155, (FIG. 4), which could be a conventional filament light, but more preferably a light emitting diode (LED), indicates when the household power is interrupted. In such an event, the power to illuminate indicator light 155 is supplied by one or more of the battery(s) 205 etc., in the timer of the invention, and is actuated when a normally On switch connecting the indicator light 155 to a source of battery power through a switch (not shown) which switch is held open (Off) by the household power and which, upon interruption of the household power, is permitted to close into the normally On position thereby completing a circuit with one or more of the rechargeable battery(s).

Figure 5:
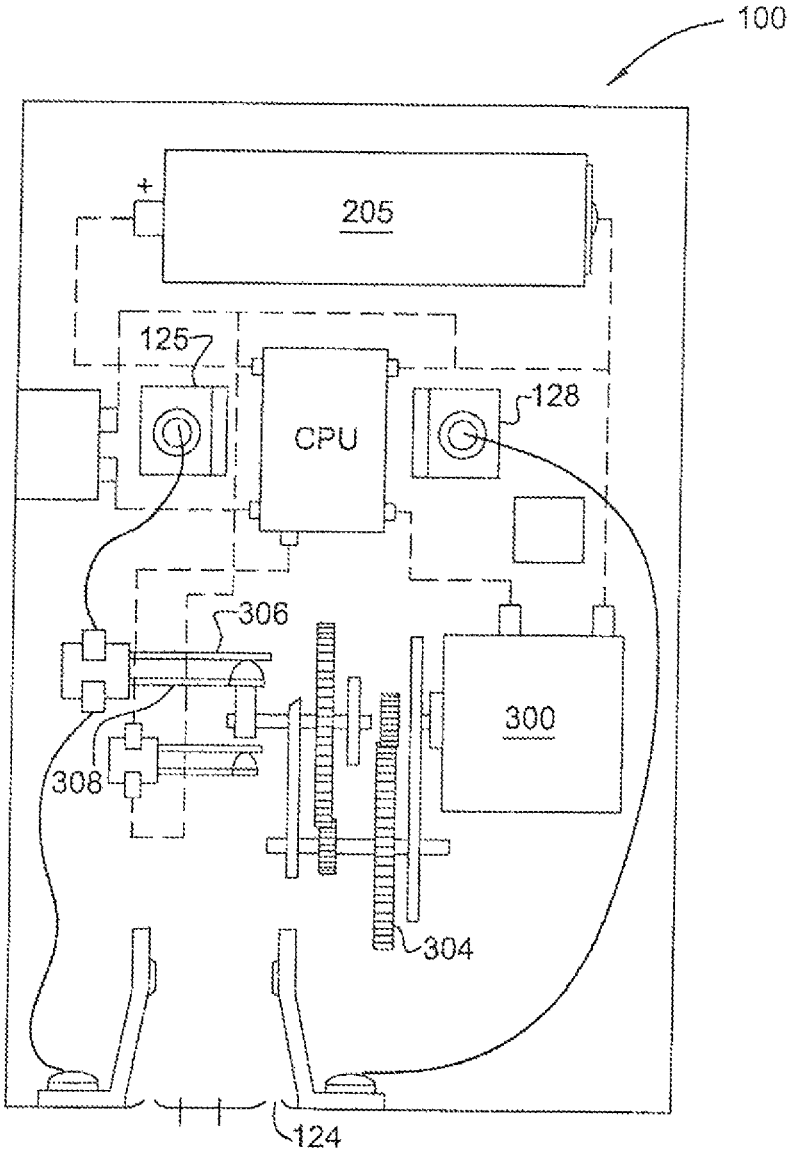
FIG. 5 is a schematic illustration of one form of a DC motor operated solely by battery power.

In a further embodiment of the invention, shown in FIG. 5, a miniature DC motor 300, powered solely by battery(s) 205 operates a drive chain 304, which drive chain 304 can be directly connected to open or close switches 306, 308 to operatively connect the source of household power entering timer 100 through prongs 122, 123 to connect them directly to output receptacle 124. An integrated circuit or CPU can be programmed to set the time of actuation, and/or deactuation of switches 306, 308. Alternatively the drive chain 304 can be directly connected to dial 112, such that mechanical switches are actuated by the actuators 114 placed on the periphery of the dial 112 as previously described. Placement of the actuators 114 can be facilitated by providing indicia 140 on the face of dial 112, the indicia representing units of time and/or subdivisions thereof as previously described.

In a still further embodiment of the invention, case 110 is provided with a charging station 200 (FIG. 4) to be used to charge rechargeable batteries 210, 220 other than batter(s) 20 within case 110. As noted above, the batteries 210, 220 in charging station 200 may be of a size/type different than the rechargeable battery(s) 205. Although I have illustrated the charging of two batteries 210, 220 in charging station 200, it should be expressly understood that such is exemplary only, and a greater or lesser number of batteries can be charged in charging station 200. Springs (not shown) placed against the charging terminal(s) can be used to accommodate batteries of different lengths/sizes. In a preferred arrangement the springs are arranged on only one side of the charging station in order to bias the battery towards the other charging terminal. For example, the spring may be arranged on the right side of the device in order to push the smaller batteries toward the left side of the device where the positive contact is located. Alternatively a movable terminal, such as a screw adjustable terminal, might be provided to accommodate different lengths of battery(s). It is also to be understood that battery(s) recharged in charging station 200 may be used for purposes completely independent of the timer 100 of the invention, i.e., they may be used as flashlight batteries or for powering battery powered devices.

However, in a still further embodiment of the invention, the battery(s) within charging station 200 may be used as an auxiliary source of power to timer 100, or as a supplement to battery(s) 205 contained in the case 110 of timer 100. In such as case, an electrical link (not shown) is provided to electrically connect the external rechargeable battery(s) located in recharging station 725 (FIG. 7) to the timer.

Figure 6:
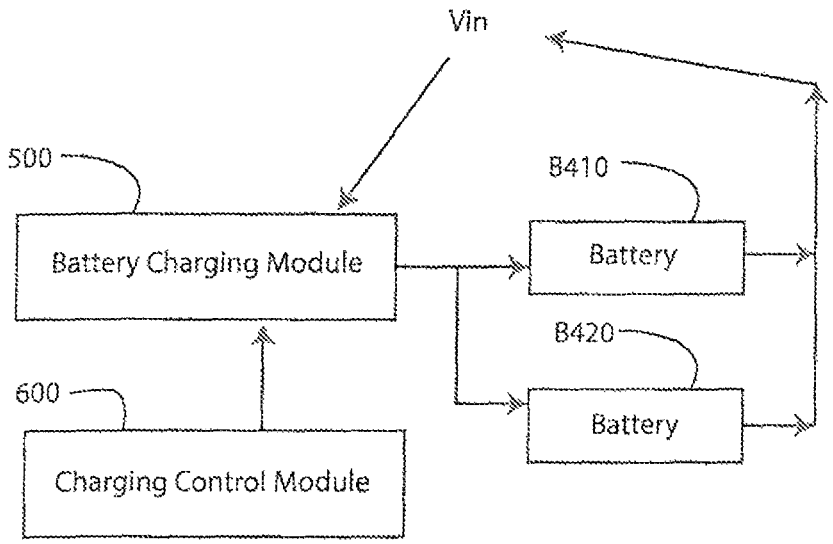
FIG. 6 is a block diagram illustrating a dual mode battery charging device constructed in accordance with a preferred embodiment of the present invention; and, FIG. 7 is a schematic, front view of an alternative form of the timer of the invention, that is, a digital appliance/light timer according to the invention.

FIG. 6 is a block diagram of a dual mode battery charging device of the present invention in which 500 denotes battery charging section from a power Voltage input terminal (abbreviated "Vin") if only a first battery B410 is to be charged. Also, if only a second battery B420 is being charged, the operation is identical to the charging of only the first battery B410, but controlled by charging control module 600. However, it is possible that the first battery B410 and the second battery B420 can both be charged simultaneously. Knowledge of a circuit permitting such an operation is known to those skilled in the art. A suitable circuit of the type disclosed in U.S. Pat. No. 5,717,309, herein incorporated by reference in its entirety, can be used to charge battery B410, battery B420 and/or both simultaneously. It should be understood that either battery B410 or battery B420 of FIG. 6 could represent the battery(s) 205 in FIG. 3, and the other battery could represent one (or more) of the batteries 210, 220 in the charging section 200 of FIG. 4.

As a still alternative embodiment, the battery(s) of the invention could be used as the sole source of electrical power, such as low voltage external lights. In such cases, the source of power to the battery charging station could be household power, or alternatively, solar panels or wind power. However, when the timer is activated, a mechanical (or digital) switch could connect the lights to the rechargeable battery and not to either the household current or to the solar panel or wind power. In such a case the Vin of FIG. 6 could represent the output of one or a plurality of solar panels to provide the power required to charge battery B410, battery B420, or both, simultaneously.

Figure 7:
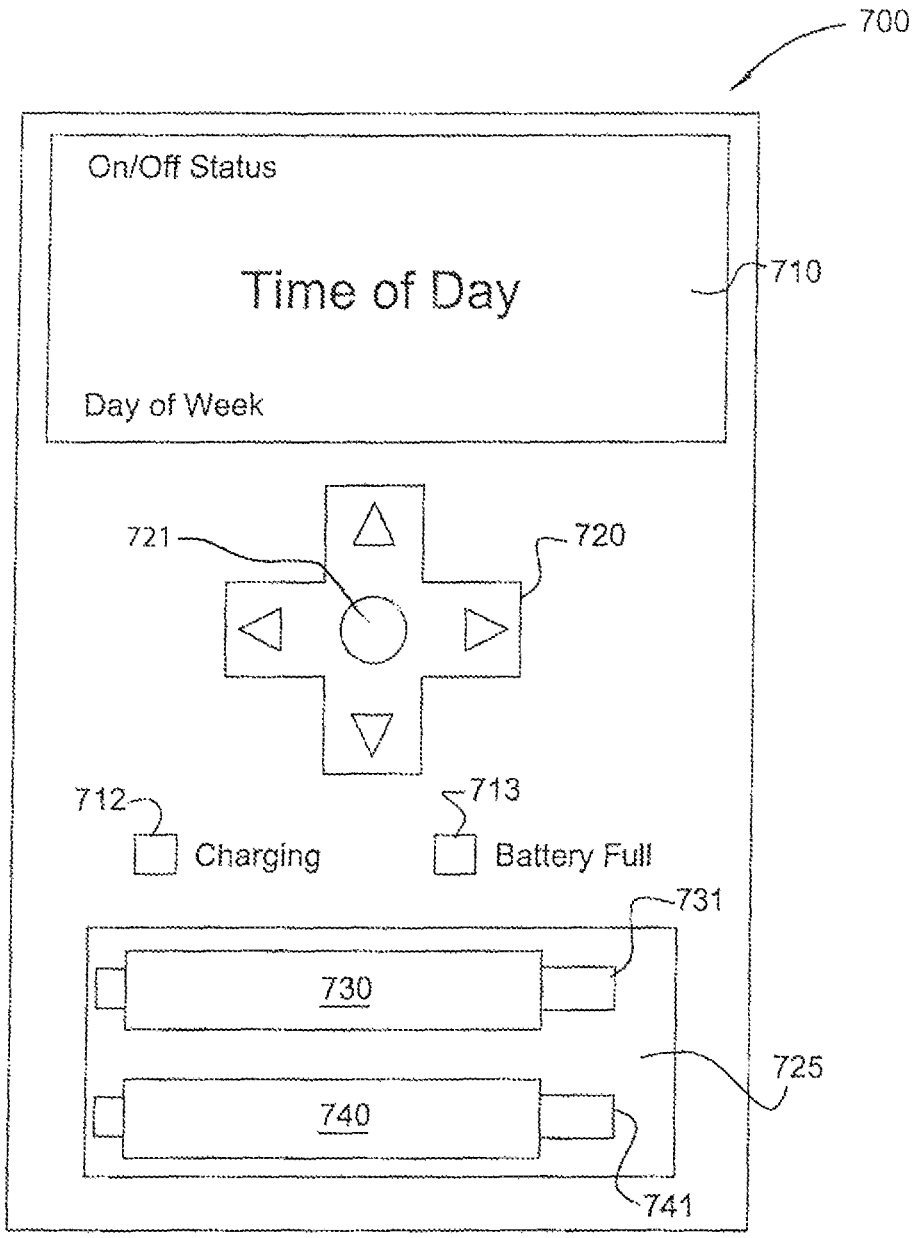

In FIG. 7 is shown a further embodiment of the invention. The appliance/light timer 700 according to this alternative embodiment has a face provided with a display 710, which may display such information as the On/Off status of the timer device, the time of day (and additionally the day of the week, the date, the month, etc.). Indicia lights 712 and 713 may indicate whether the battery(s) are charging, or that the battery(s) are fully charged, or the status of the household power, respectively. As with other indicia lights disclosed in this specification, the lights may be incandescent filament bulbs, or alternatively, light emitting diodes (LEDs). A rocker/selector 720 to set or alter the information displayed on display 710 may also be provided. The rocker/selector is provided with a selector 721 to enable various functions of the appliance/light timer 700. For example, depressing selector 721 may be configured and used as a simple switch to simply turn On or OFF various functions of timer 700. In one embodiment, it may "select" the information visible on the display, such as the time/date of a desired function. In other embodiments, the selector 721 may be used to delay, set, or terminate the duration of time to provide power to one or more external lights/appliances. In various embodiments, "indicia" (not shown) may be placed upon or near selector 721, such as "select", "ON/OFF", or universal symbols to show the function. The recharging station 725 of FIG. 7 illustrates two battery(s) 730, 740 may be inserted into charging station 725. Springs 731, 741, respectively, hold the battery(s) 730, 740 in place, and assist in the electrical charging of the battery(s). As described above, the springs may accommodate various lengths of battery(s) by biasing shorter battery(s) towards the positive charging terminal, or the charging terminals may be made adjustable to accommodate various lengths of battery(s). The springs employed may have various configurations to bias the battery(s) including, without limitation, coil, elliptic, leaf, helical, or, without limitation, any other type of spring sufficient to impart the biasing effect to shorter battery(s). The spring itself may be electrically conducting, such as a wire spring, or the spring may be non-electrically conducting and serve as the mechanism upon which the electrically charging terminal is located.

Without departing from the spirit of the invention disclosed herein in the several exemplary and different embodiments, changes may be made in its form and in the construction and interrelationship of its component parts by those of ordinary skill in the art upon reading the present specification in conjunction with the attached drawings and without the exercise of invention.

I claim:

1. A timer for use in connecting a source of household electrical power to an electrically powered device(s), the timer comprising a case;

the case holding at least one output receptacle(s) for receiving a plug(s) of an electrically powered device(s);

the case provided with elements to electrically connect to a source of household electrical power;

the timer being further provided with a first rechargeable battery, the first rechargeable battery being charged by the household electrical power;

the timer further comprising two electric motors, one electric motor being an AC motor operated by the household current, the second electric motor being a DC motor operated by the first rechargeable battery(s); and, at least one On-Off actuator(s) for electrically connecting the source of household power to the outlet receptacle (s).

2. The tinier of claim 1, wherein the AC electric motor is operatively connected to a drive chain to periodically actuate the at least one On-Off actuator(s).

3. The timer of claim 2, wherein the at least one On-Off actuator(s) is located on a dial rotated by the AC motor through the drive chain.

4. The timer of claim 1, wherein the elements to electrically connect to a source of household electrical power comprise at least two prongs.

5. The timer of claim 1, further comprising an external charging station to charge at least one second rechargeable battery(s).

6. The timer of claim 5, wherein the external recharging station charges a plurality of second battery(s).

7. The timer of claim 2, further comprising an external charging station to charge at least one second rechargeable battery(s).

8. The timer of claim 6, wherein the second rechargeable battery that powers the timer does not power the electrical motor.

9. The timer of claim 6, wherein the second rechargeable battery that powers the timer also powers the electrical motor.

10. A timer for use in periodically connecting a source of battery electrical power to at least one output receptacle into which receptacle(s) an electrically powered device(s) is connectable, the timer comprising a case;

the case holding an output receptacle(s) for receiving a plug of the electrically powered device(s);

the timer being further provided with at least a first rechargeable battery(s) contained within the case; the first rechargeable battery(s) being directly charged by at least one selected from the group consisting of solar power and wind power;

the case provided with elements to periodically electrically connect the output receptacle(s) to the first rechargeable battery(s); and, at least one On-Off actuator(s) for electrically connecting the battery(s) to the output receptacle(s);

wherein the elements to periodically electrically connect the output receptacle(s) to the first rechargeable batteries comprise a DC motor; a drive chain operatively connecting the motor to a dial; the dial comprising actuators to mechanically engage a switch to connect the battery(s) to the output receptacle(s).

11. The timer of claim 10, wherein the dial further comprises indicia representing units of time.

12. The timer of claim 10, further comprising a charging station to hold at least one additional rechargeable battery(s).

13. The timer of claim 12, wherein the at least one additional battery(s) that powers the timer is not operatively connected to the motor.

* * * * *